US006398493B1

(12) United States Patent
Chien et al.

(10) Patent No.: US 6,398,493 B1
(45) Date of Patent: Jun. 4, 2002

(54) FLOATABLE IMPELLER FOR MULTISTAGE METAL WORKING PUMP

(75) Inventors: Huan-Jan Chien; Pao-Yin Ou, both of Hsinchu; Shu-Fen Kao, Taipei; Rong-Jau Liaw, Hsinchu, all of (TW)

(73) Assignee: Industrial Technology Research Institute (TW)

( * ) Notice: Subject to any disclaimer, the term of this patent is extended or adjusted under 35 U.S.C. 154(b) by 0 days.

(21) Appl. No.: 09/658,443

(22) Filed: Sep. 8, 2000

(30) Foreign Application Priority Data

Feb. 2, 2000 (TW) ..... 89201924 U

(51) Int. Cl.[7] ..... F04D 29/60

(52) U.S. Cl. ..... 415/199.2; 415/214.1; 415/200

(58) Field of Search ..... 415/199.1, 199.2, 415/199.3, 200, 214.1, 104, 229, 169.1, 121.2

(56) References Cited

U.S. PATENT DOCUMENTS 1,569,092 A * 1/1926 Keating ..... 415/199.1
3,402,670 A * 9/1968 Boyd ..... 415/199.2
4,872,808 A * 10/1989 Wilson ..... 415/170.1
5,133,639 A * 7/1992 Gay et al. ..... 415/199.1
5,234,317 A * 8/1993 Kajiwara et al. ..... 415/214.1
5,256,033 A * 10/1993 Kajiwara ..... 415/214.1
5,295,786 A * 3/1994 Kajiwara ..... 415/172.1
5,318,403 A * 6/1994 Kajiwara et al. ..... 415/214.1
6,016,224 A * 8/2000 Sheth et al. ..... 415/104
6,267,555 B1 * 7/2001 Chien et al. ..... 415/200

* cited by examiner

*Primary Examiner*—F. Daniel Lopez
*Assistant Examiner*—Richard Woo
(74) *Attorney, Agent, or Firm*—Troxell Law Office PLLC

(57) ABSTRACT

A floatable impeller for multistage metal working pump includes an impeller hub which has an impeller metal working member supporting a rear wall of the impeller and an impeller plastic member integrally formed with the impeller working member. The impeller plastic member is engaged with and driven by the pump shaft. The impeller has a front wall attached with an impeller thrust ring which has a thrust metal working member integrally formed with a thrust plastic member located in front of the impeller front wall. The thrust plastic member serves as a bearing when rotating against a metallic pump shell of an adjacent pump unit for reducing friction loss. The impeller hub has axial grooves formed in the inside wall. The thrust plastic member has radial slots formed in the sidewall. The grooves and slots may collect and discharge grits and sands carried by fluid and generated by friction for reducing friction, improving pumping efficiency and enhancing pump durability.

7 Claims, 9 Drawing Sheets

FLOATABLE IMPELLER FOR MULTISTAGE METAL WORKING PUMP

FIELD OF THE INVENTION

This invention relates to a floatable impeller for multistage metal working pump and particularly for submersible pump (water-sunken pump) that has thrust bearing means movable axially along the shaft for a desired distance for reducing rotation friction between the impeller and pump shell and to facilitate assembly.

DESCRIPTION OF THE PRIOR ART

Conventional multistage centrifugal pumps (such as submersible pumps) usually have a plurality of pump shell units and impellers stacked in series along a shaft. The shaft rotates the impellers against the pump shells and generates centrifugal force for fluid to flow in the passage through the pump shells. Traditional multistage pumps made by casting is heavy, bulky and has lower pumping efficiency. They are increasing being replaced by metal working pumps.

However metal working pump shell is usually made by stamping or pressing and is difficult to reach precise dimension required. The pump shell is prone to deformation under high pumping pressure. The sealing is prone to malfunction and result in leaking. The high speed rotating impeller is easy to make friction against the stationary pump shell and result in lowering pump service life and dropping of pumping efficiency. Different fluid flow speed and volume may also cause displacement change of the impeller and result in friction against pump shell.

There are prior arts (such as ROC U.S. patent application No. 86,221,555) that propose plastic impellers for the multistage pump. The plastic impellers are floatable and axially movable along the shaft for a selected distance. While it costs less and is easier to assemble, the plastic impeller also serves as a bearing and is easily worn out under high speed friction against metallic pump shell. It also cannot be used as floatable impeller for multistage pump. There are many other prior arts being disclosed, such as U.S. Pat. Nos. 4,877,372, 5,082,425, 5,344,678, 5,425,618, 5,201,848, 5,234,317, 5,133,639, EP U.S. Pat. Nos. 04,925,71A1, 02,573,58A2, PCT No. WO. 94/23211, DE U.S. Pat. No. 44,461,93C2. All of them still do not fully resolute the problems set forth above.

SUMMARY OF THE INVENTION

It is an object of this invention to provide an improved floatable impeller for multistage metal working pump that is simple to align and position for easy assembly and has novel shaft sleeve and thrust pressure absorbing means to reduce friction between the impeller and pump shell.

It is another object of this invention to provide an improved floatable impeller that has slot recesses formed in the bearing means and thrust pressure absorbing means for collecting and discharging sand and grits in the fluid or resulting from the friction so that pumping efficiency may be improved and the pump may have longer durability.

According to this invention, the pump includes a plurality of pump shell units stacked in series along a shaft to form a multistage pump. Each pump shell unit has a metal working impeller and diffuser. The shaft rotates the impeller to draw fluid flowing from an inlet of the impeller through the diffuser across different stages of the pump.

The impeller further has an impeller hub and an impeller thrust ring. The impeller hub is integrally formed by a metallic impeller metal working member upon which the impeller is soldered on and an impeller plastic member which has a shaft bore formed therein for holding and rotating with the shaft synchronously. The impeller thrust ring includes a metallic thrust metal working member soldering on a front wall of the impeller around the inlet and a thrust plastic member mounting on the thrust metal working member.

When in use, the thrust plastic member of one pump shell unit faces against the pump shell of an adjacent pump shell unit. The friction of the thrust plastic member against the pump shell during high speed rotation of the impeller is a friction between plastic and metal. The friction wearing is less than metal to metal contact friction of conventional pump.

The diffuser is soldered to and supported by a diffuser collar. The diffuser collar includes a metallic diffuser metal working member which is integrally formed with a diffuser plastic member which in turn has a center hole to house a shaft sleeve therein. The shaft sleeve has a center bore to engage with the shaft. The shaft and shaft sleeve are rotating synchronously in the diffuser plastic member. There is a bakelite ring sandwiched between the diffuser plastic member and impeller plastic member. The structure set forth above makes rotation friction happen between plastic and plastic and may result in lower friction loss.

Furthermore there are radial slots formed in the side wall of the impeller plastic member facing the diffuser collar and the thrust plastic member remote from the thrust metal working member. And there are axial slots formed in inner side of the impeller plastic member. All those slots may collect and discharge grits and sands produced or resulting from friction between the rotating elements against the stationary element in the pump shell unit so that friction loss may be reduced, pumping efficiency may be increased and durability of the pump may be enhanced.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
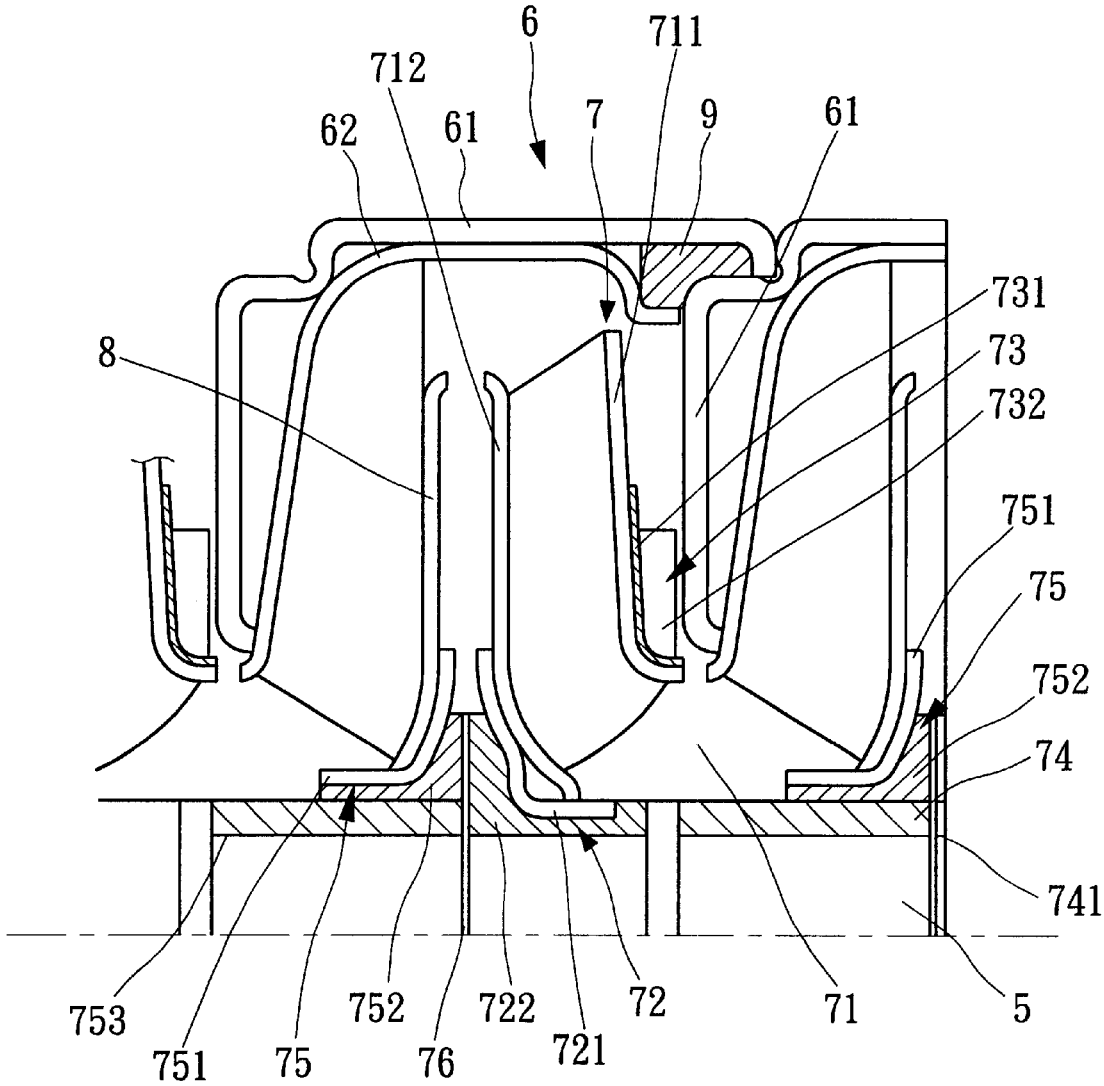
FIG. 1 is a fragmentary sectional view of this invention.
Figure 2:
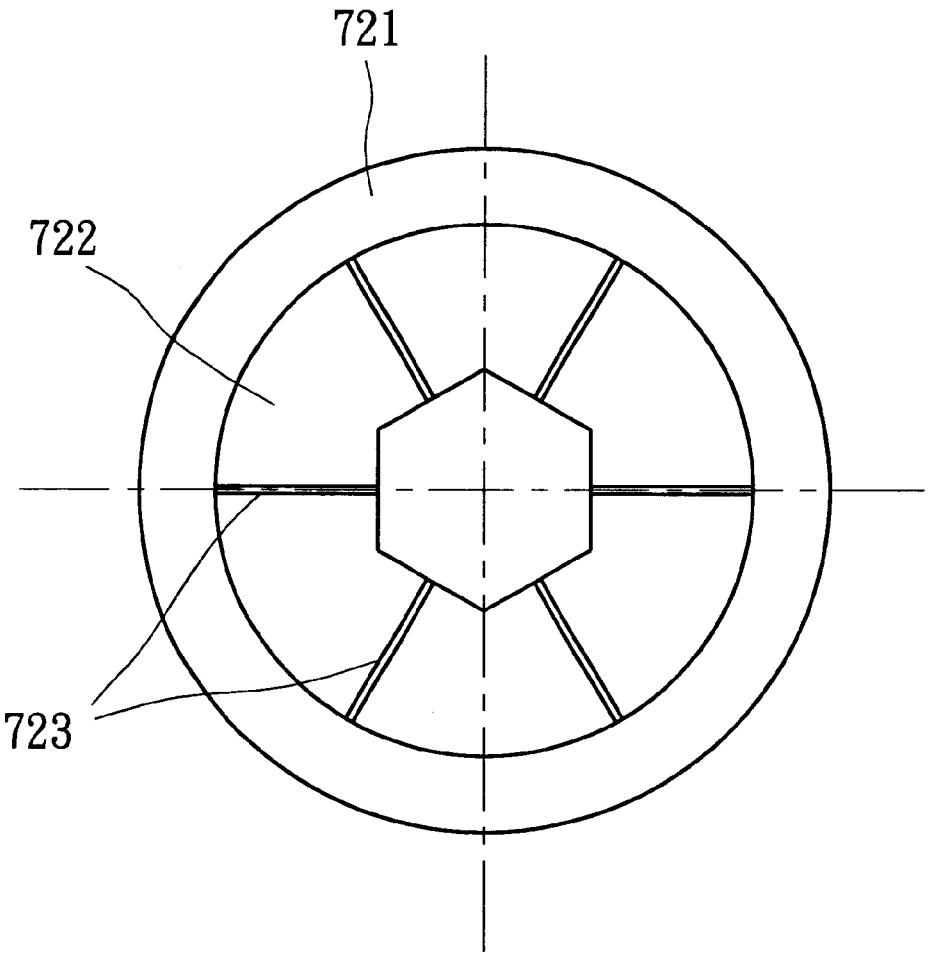
FIG. 2 are plane and sectional views of an impeller hub of this invention.
Figure 2:
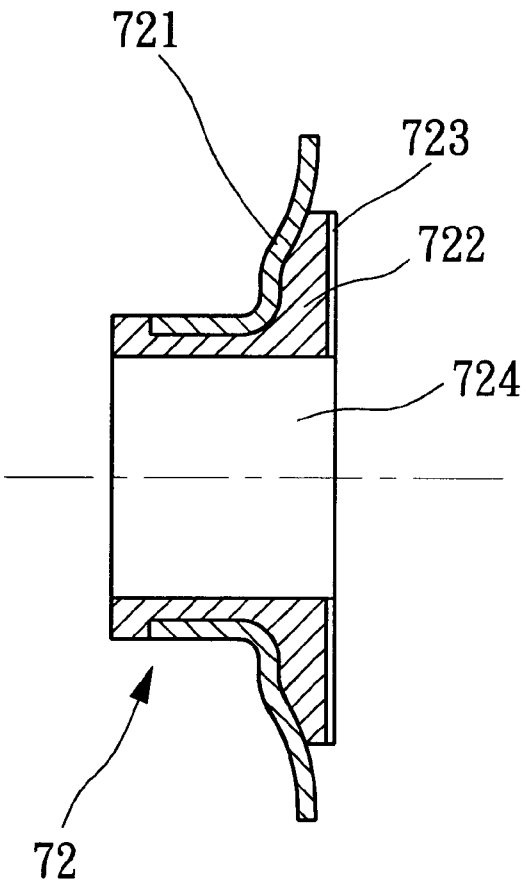
Figure 3:
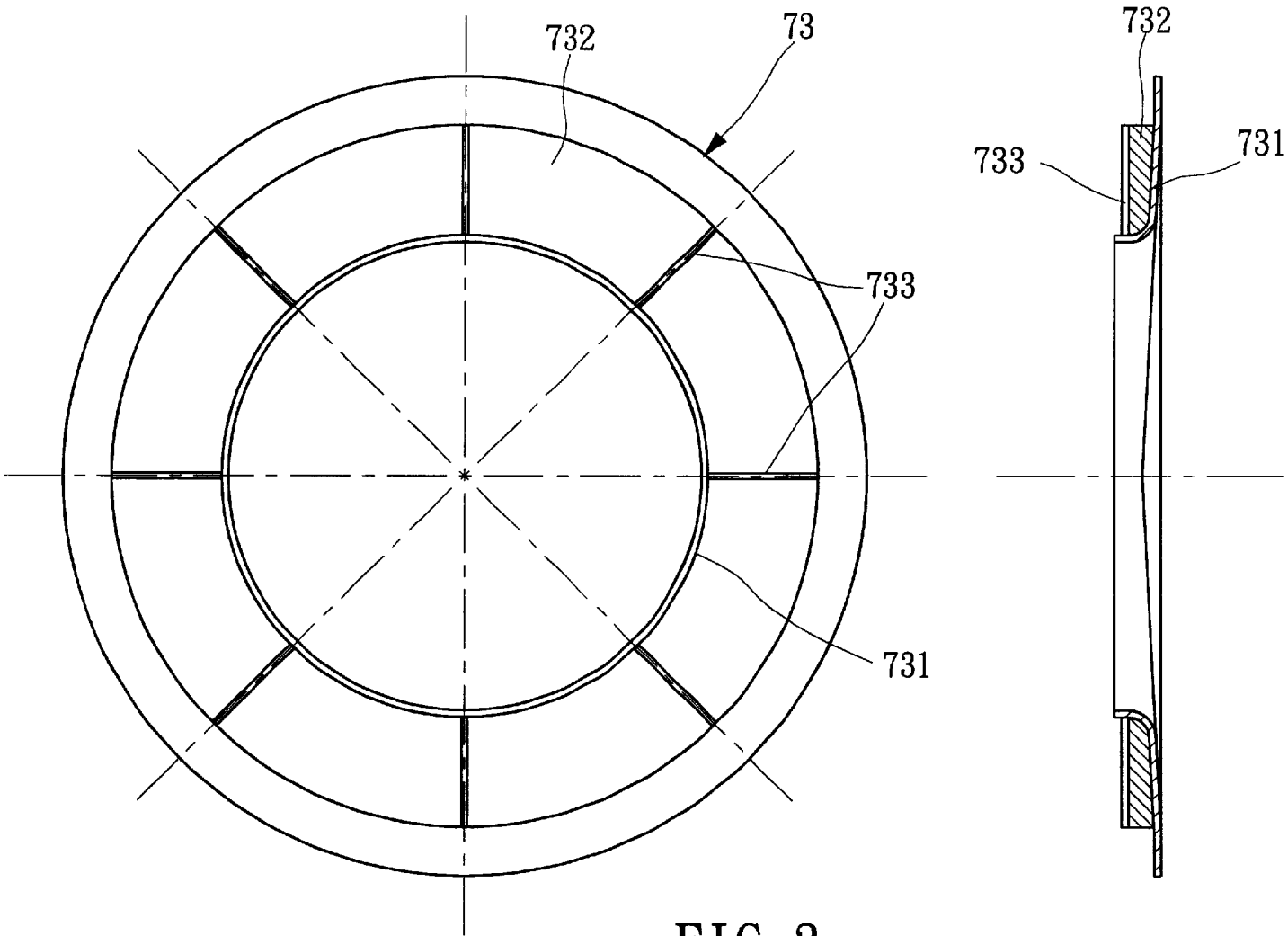
FIG. 3 are plane and sectional views of an impeller thrust ring of this invention.
Figure 4:
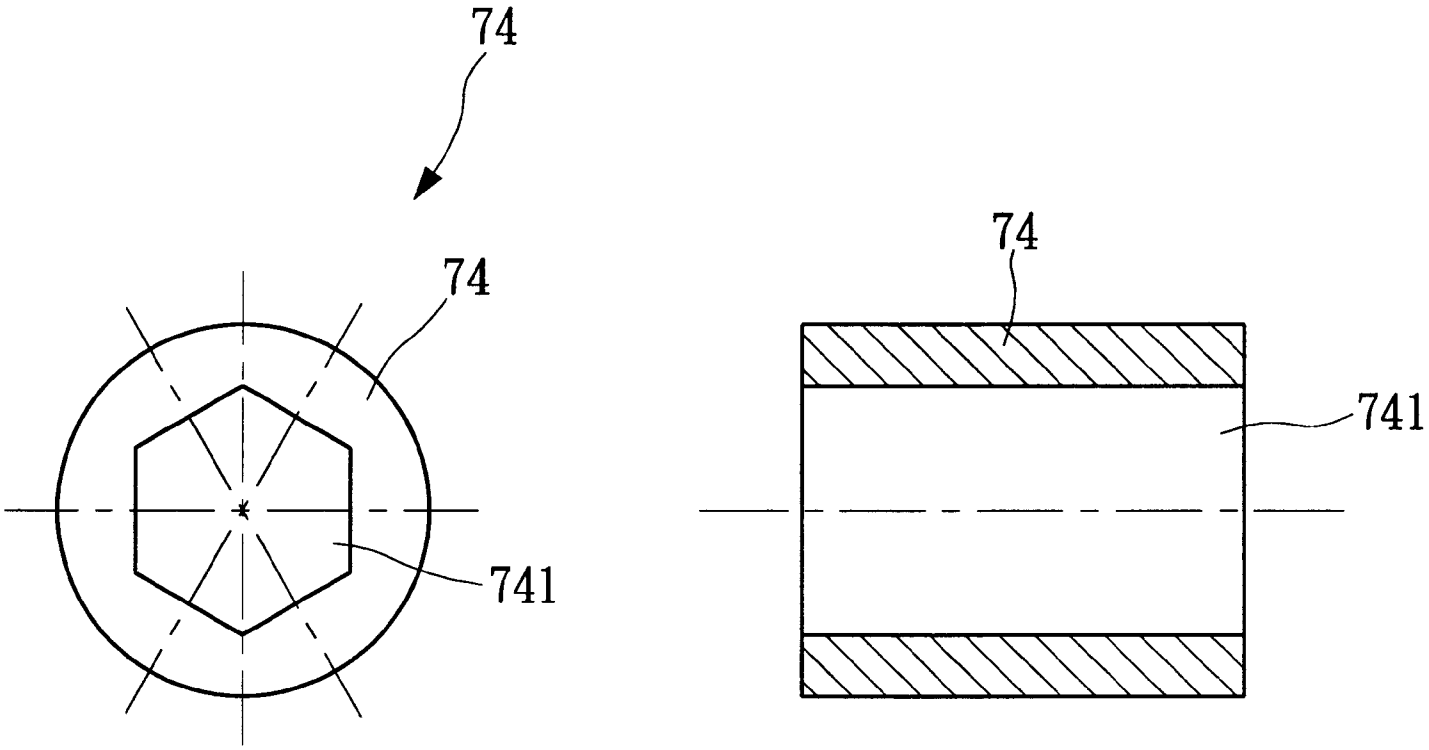
FIG. 4 are plane and sectional views of a shaft sleeve of this invention.

Referring to FIG. 1, the multistage metal working pump according to this invention includes a plurality of pump shell units 6 (two sets of adjacent pump shell units are shown in the figure) stacked in series on a shaft 5. Each pump shell unit 6 includes a diffuser unit (constitutes an outer shell 61, inner shell 62 and a diffuser 8), an impeller 7 and a seal ring 9. The shaft 5 drives the impeller 7 to rotate in the shells 61 and 62 to draw fluid to flow from an impeller inlet 71 through the diffuser 8 and to a next stage pump shell unit. The structure of the shaft 5, shells 61, 62, seal ring 9 and diffuser 8 are known in the arts and form no part of this invention, thus will be omitted in the description below.

Details of the floatable impeller structure are shown in FIGS. 1 through 6. The metal working impeller 7 includes a front wall 711, a rear wall 712 and a plurality of blades (not marked in figures) sandwiched between the front and rear wall. The impeller 7 further has an impeller hub 72, an impeller thrust ring 73, a shaft sleeve 74, a diffuser collar 75 and a bakelite ring 76.

The impeller hub 72 includes a metallic (preferable stainless steel) impeller metal working member 721 for soldering with and supporting the rear wall 712 of the impeller 7, and an impeller plastic member 722 (preferably made of PBT or engineering plastics) integrally formed with the impeller metal working member 721. The plastic member 722 has a shaft bore 724 engaged with the shaft 5 and may be rotated synchronously for transmitting power from the shaft 5 to the impeller 7. The impeller metal working member 721 engages with the impeller 7 at the contact portion (shown in FIG .2) around the shaft 5. The impeller plastic member 722 has a plurality of radial slots 723 formed in a side wall thereof adjacent the diffuser collar 75.

The impeller thrust ring 73 (FIG. 3) includes a metallic thrust metal working member 731 soldered to the front wall 711 and is integrally formed with a thrust plastic working member 732 which is mounted on a lower portion of the thrust metal working member 731 around the inlet 71. The thrust plastic member 732 is formed against the contact surface of the thrust metal working member 731 and has a plurality of radial slots 733 formed in a side wall remote from the thrust metal working member 731.

When in use, the impeller 7 may slightly move axially along the shaft 5 for a desired distance when subject to thrust pressure resulting from pump operation. Thrust force coming from the inlet 71 direction might drive the thrust plastic member 732 rotating against the pump shell 61 of a next stage pump shell unit like a bearing. It is a friction between plastic and metal. The friction loss is lower than conventional metal (impeller) to metal (pump shell) friction. Please refer to FIG. 4. The shaft sleeve 74 is made of plastics and has a shaft bore 741 for engaging and rotating synchronously with the shaft 5. One end the shaft sleeve 74 is adjacent the impeller plastic member 722.

Figure 5:
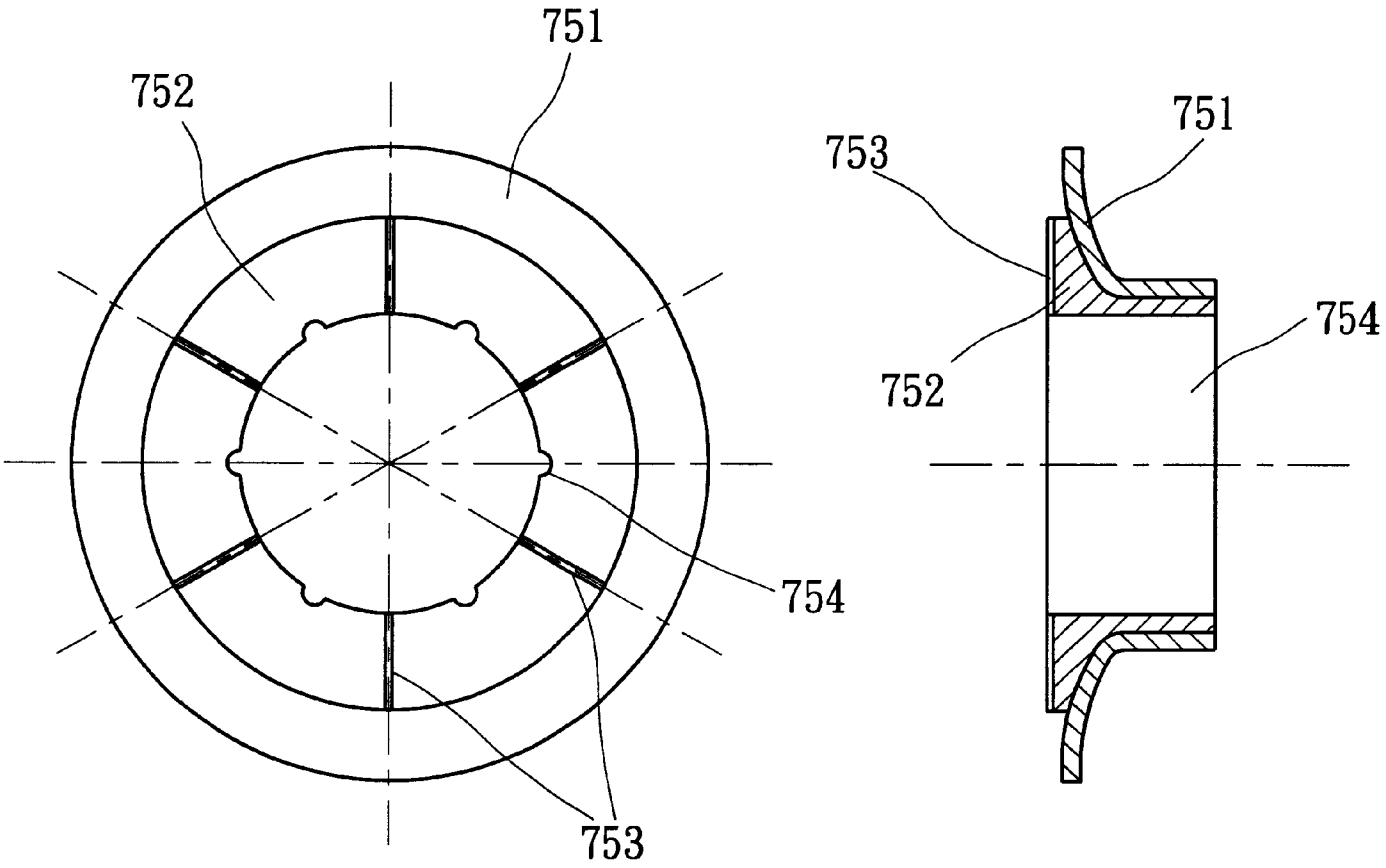
FIG. 5 are plane and sectional views of a diffuser collar of this invention.

Referring to FIG. 5, the diffuser collar 75 includes a metallic diffuser metal working member 751 integrally formed with a diffuser plastic member 752. The diffuser 8 is soldered on the diffuser metal working member 751. The diffuser plastic member 752 has a center hole to enable the shaft sleeve 74 to rotate herein. Hence the diffuser plastic member may function as a bearing for the shaft 5 and shaft sleeve 74. The diffuser metal working member 751 is mapping against the contact portion of the diffuser 8. The diffuser plastic member 752 has a plurality of radial slots 753 formed in a side wall thereof. The diffuser plastic member 752 also has a plurality of axial grooves 754 formed around a center hole thereof facing the shaft sleeve 74. As an alternative, the axial grooves 754 may be located on the outer surface of the shaft sleeve 74 instead of in the diffuser plastic member 752. The radial slots 753 and axial grooves 754 can discharge sands and particles from the contact surfaces during fluid pumping operation.

Figure 6:
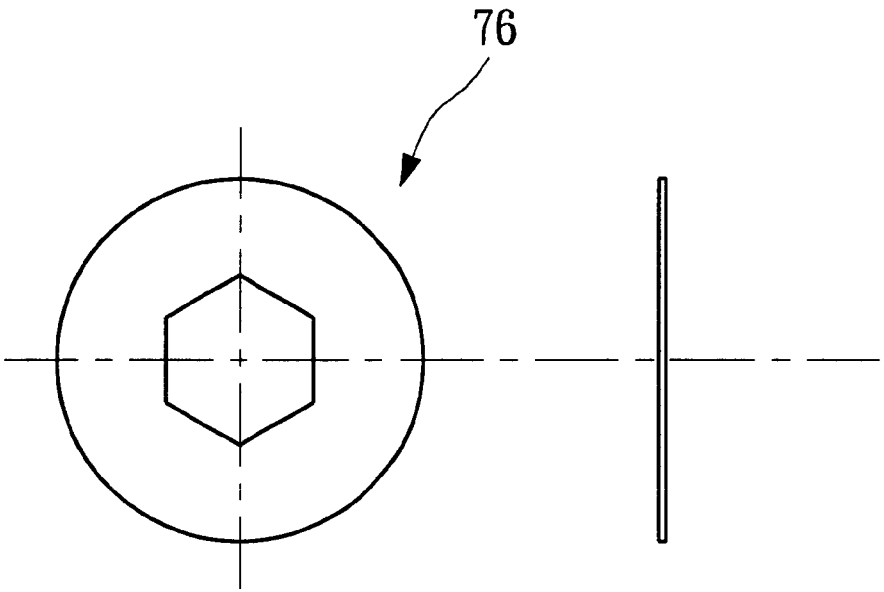
FIG. 6 are plane and sectional views of a bakelite ring of this invention.

FIG. 6 shows an annular bakelite ring 76 which is located between the impeller plastic member 722 and diffuser plastic member 752 and may be rotated synchronously with the shaft 5 to serve as a bearing for absorbing axial thrust pressure force between the impeller and the diffuser during pumping operation and reducing friction loss.

Figure 7:
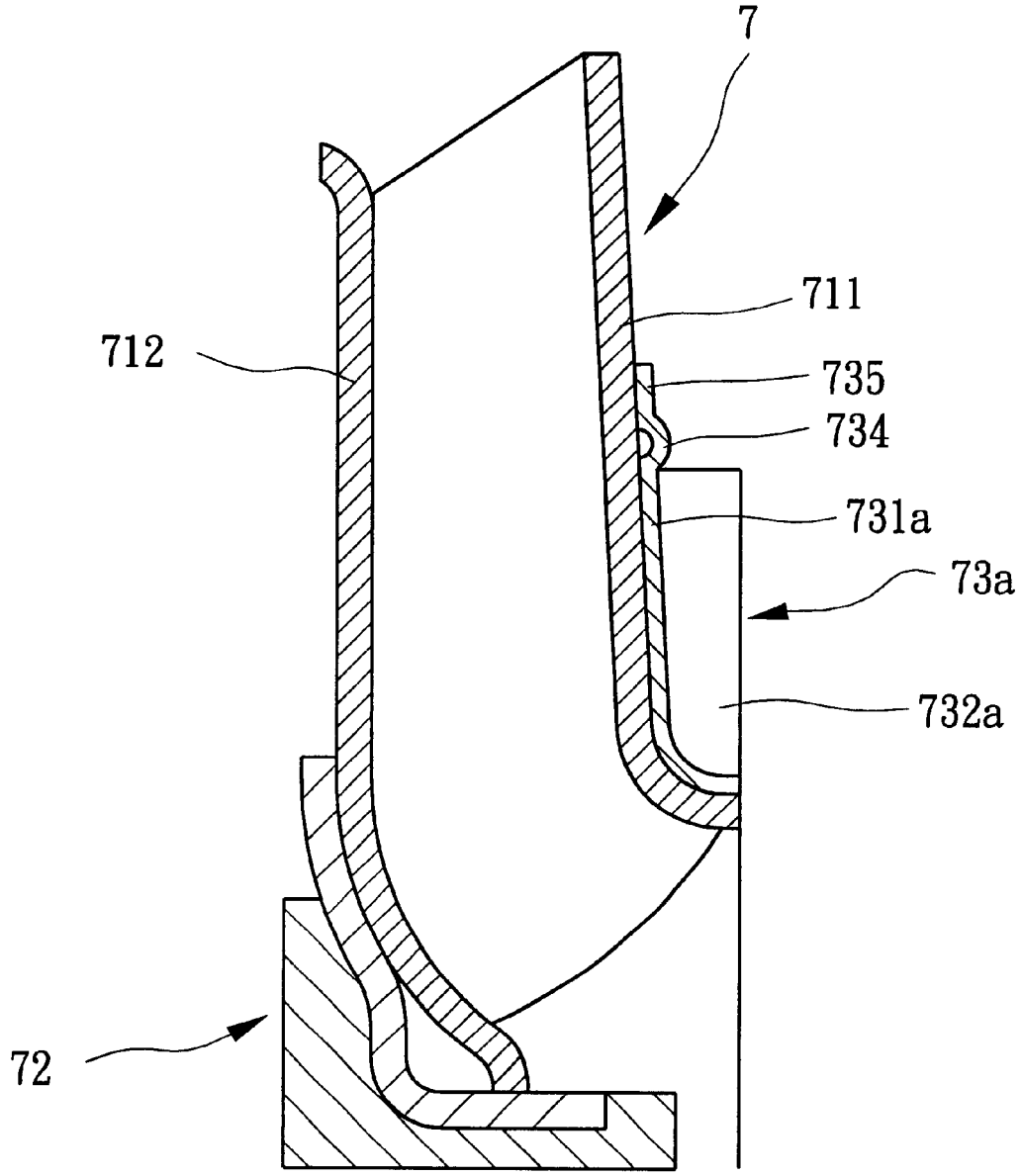
FIG. 7 is a fragmentary sectional view of another embodiment of an impeller thrust ring.

FIG. 7 shows another embodiment of the impeller 7 in which the impeller thrust ring 73*a* has a thrust metal working member 731*a* integrally formed with a thrust plastic member 732*a* which also have radial slots formed therein (not shown in the figure). However at the upper portion of the thrust metal working member 731*a,* there is provided with a resilient member 734. The front wall 711 is soldered to the thrust metal working member 731*a* at a soldering zone 735 located above the resilient zone 734. The other contact area between the front wall 711 and the thrust metal work member 731 is free without binding nor soldering. With such a structure, when the impeller 7 is subject to high thrust pressure during pumping operation, the impeller thrust ring 73*a* may be slightly deformed and adjusted so that the thrust plastic member 732*a* may made smooth and even contact with the pump shell of the adjacent pump to reduce friction.

The shaft 5 used in this invention has a hexagonal crosssection. The shaft bores 724 and 741 also has same hexagonal crosssection to engage positively with the shaft 5 for transmitting rotation power. Of course other shaft rotation transmission means such as key and keyway, tooth and the like may also be used equally well.

Because of the present of the slots and grooves such as 723, 733 and 753, sands and grits coming from fluid or resulting from rotation friction may be collected and discharged out quickly from the rotation surfaces. It can effectively reduce friction loss, improving pumping efficiency and enhancing durability of the shaft sleeve and thrust ring.

Figure 8:
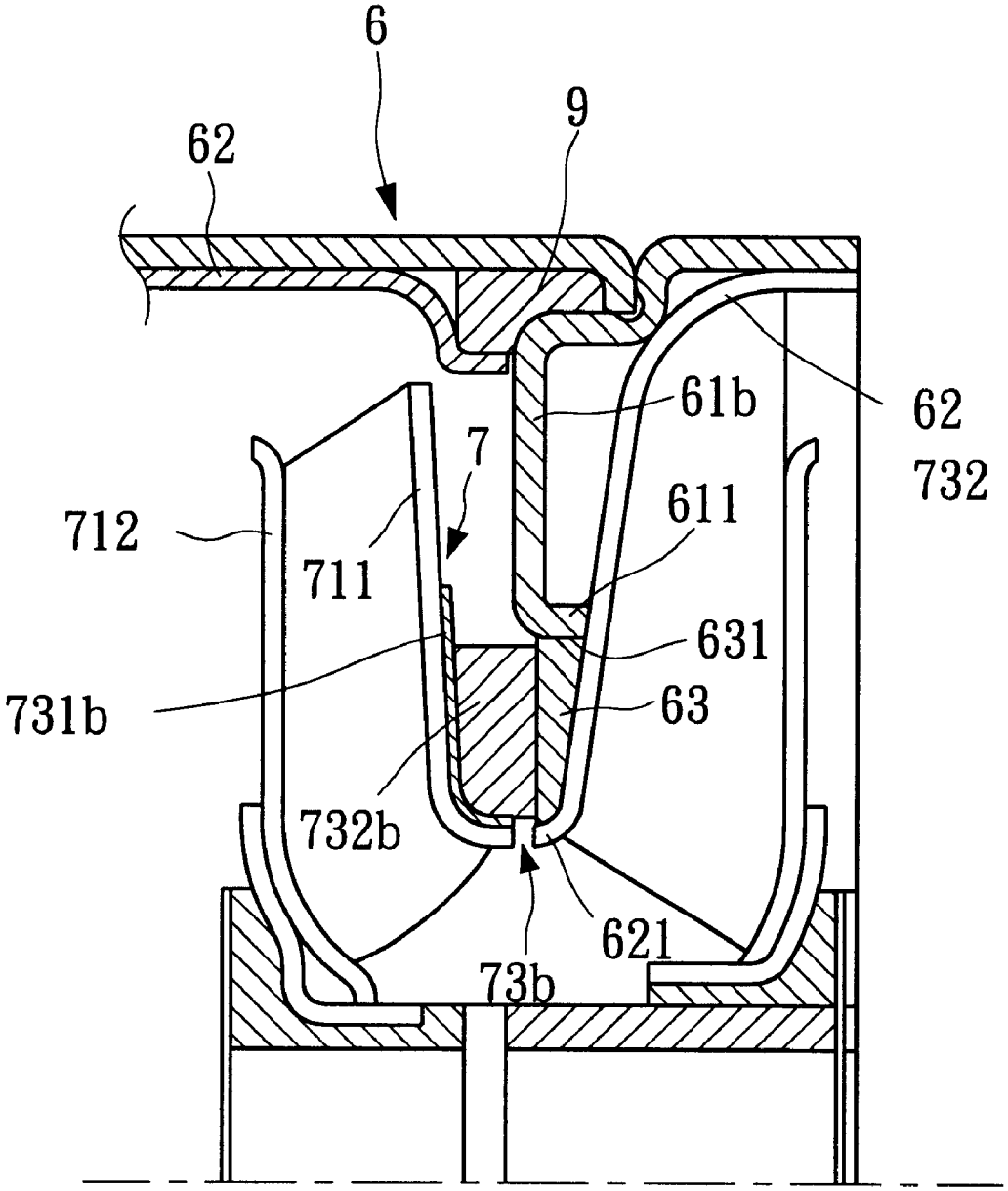
FIG. 8 is a fragmentary sectional view of another embodiment of the floatable impeller.
Figure 9:
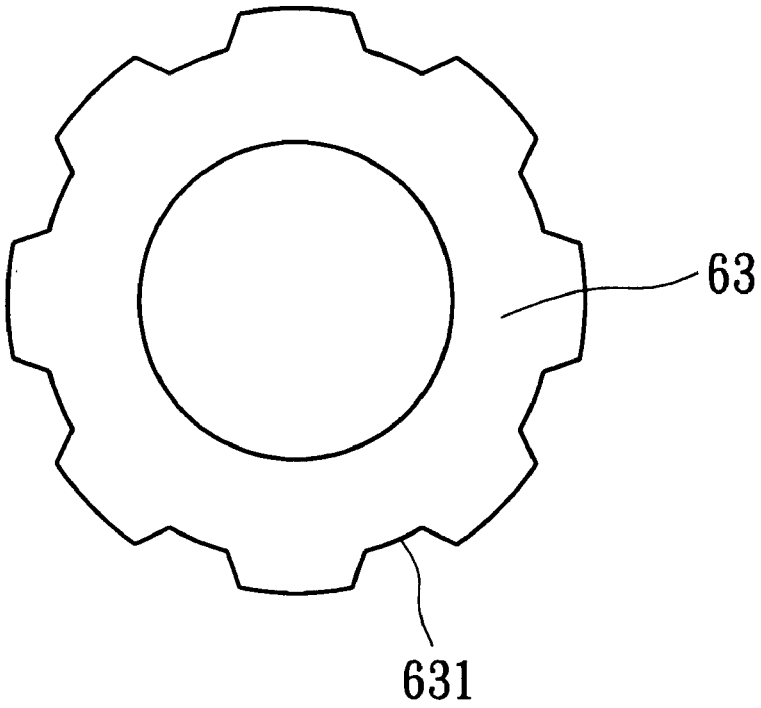
FIG. 9 is a plane view of a wear-resistant thrust ring of this invention.

FIGS. 8 and 9 show a further embodiment of this invention. Same components will be marked by same numerals without further description. Similar components will be marked by a numeral affixed with an additional alphabet. The main difference includes to add a wear-resistant ceramic thrust ring 63 above a front end ring 621 of the outer shell 62 below an outer rim 611 of the outer shell 61*b*. The thrust plastic member 732*b* is extended outward to face against the thrust ring 63. The thrust ring 63 have tooth like outer rim 631 to engage securely with the front end inner rim 611. Because both the thrust plastic member 732*b* and the ceramic thrust ring 63 have lower friction coefficient, the friction loss resulting from thrust pressure and friction noise may be further reduced. And durability of the pump may also be improved.

It may thus be seen that the objects of the present invention set forth herein, as well as those made apparent from the foregoing description, are efficiently attained. While the preferred embodiments of the invention have been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A floatable impeller for multistage metal working pump, comprising:

a plurality of pump shell units mounted in series on a shaft, each pump shell unit including an impeller and a diffuser shell made by metal working, the diffuser shell have diffusers located therein;

the impeller having an inlet, a front wall, a rear wall, and including an impeller hub and an impeller thrust ring, the impeller hub having a metalic impeller metal working member integrally formed with an impeller plastic member, the impeller metal member being fixed to the rear wall of the impeller, the impeller plastic member having a shaft bore engaged with the shaft for transmitting shaft rotation power synchronously;

the impeller thrust ring including a metallic thrust metal working member integrally formed with a thrust plastic member, the thrust metal working member being fixed to the front wall of the impeller around the inlet;

a shaft sleeve having one end adjacent to the impeller plastic member and a shaft bore engaged with the shaft for rotating synchronously with the shaft; and a diffuser collar including a metallic metal working member integrally formed with a diffuser plastic member, the diffuser metal working being fixed to the diffuser, the diffuser plastic member having a center hole therein to house the shaft sleeve such that the diffuser plastic member acts as a bearing for the shaft and shaft sleeve to rotate therein;

wherein the impeller is axially movable along the shaft a predetermined distance under thrust pressure of pumping fluid flowing from the inlet through the diffusers to an adjacent pump shell unit when the shaft drives and rotates the impeller for pumping operation such that the thrust plastic member facing and rotating against a side wall of the adjacent pump shell unit for providing a bearing function.

2. The floatable impeller of claim 1 further having a bakelite ring mounted on the shaft and located between the impeller plastic member and the diffuser plastic member.

3. The floatable impeller of claim 1 wherein the diffuser plastic member has a plurality of radial slots formed in a side wall facing the impeller hub.

4. The floatable impeller of claim 1 wherein an inside wall of the center hole of the diffuser plastic member has a plurality of axial grooves formed therein.

5. The floatable impeller of claim 1 wherein the impeller plastic member has a plurality of radial slots formed in a side wall adjacent the diffuser collar.

6. The floatable impeller of claim 1 wherein the impeller hub shaft bore and shaft sleeve shaft bore have respectively a hexagonal crosssection engageable with the shaft which has a hexagonal crosssection.

7. A floatable impeller for multistage metal working pump, comprising:

a plurality of pump shell units mounted in series on a shaft, each pump shell unit including an impeller and a diffuser shell made by metal working, the diffuser shell have diffusers located therein;

the impeller having an inlet, a front wall, a rear wall, and including an impeller hub and an impeller thrust ring, the impeller hub having a metallic impeller metal working member integrally formed with an impeller plastic member, the impeller metal member being fixed to the rear wall of the impeller, the impeller plastic member having a shaft bore engaged with the shaft for transmitting shaft rotation power synchronously; and the impeller thrust ring including a metallic thrust metal working member integrally formed with a thrust plastic member, the thrust metal working member being fixed to the front wall of the impeller around the inlet and having a resilient member located at a location remote from the shaft but spaced from an outer rim thereof, the thrust metal working member is soldered to the front wall of the impeller at a spot located between the outer rim and the resilient member, the thrust metal working member and the front wall have free contact without soldering therebetween except the soldered spot;

wherein the impeller is axially movable along the shaft a predetermined distance under thrust pressure of pumping fluid flowing from the inlet through the diffusers to an adjacent pump shell unit when the shaft drives and rotates the impeller for pumping operation such that the thrust plastic member facing and rotating against a side wall of the adjacent pump shell unit for providing a bearing function.

* * * * *